US006044990A

United States Patent [19]

Palmeri

[11] Patent Number: 6,044,990

[45] Date of Patent: Apr. 4, 2000

[54] MODULAR RACK SYSTEM AND COMPONENTS THEREFOR

[76] Inventor: Richard P. Palmeri, 1211 S. Ramona Ave., Indialantic, Fla. 32903

[21] Appl. No.: 09/083,522

[22] Filed: May 22, 1998

[51] Int. Cl.[7] ..... A47F 5/00

[52] U.S. Cl. ..... 211/189; 211/182; 403/217; 403/231

[58] Field of Search ..... 211/189, 182, 211/191; 403/217, 231

[56] References Cited

U.S. PATENT DOCUMENTS

| | | | |
|---|---|---|---|
| 3,513,606 | 5/1970 | Jones | 211/182 X |
| 3,695,649 | 10/1972 | Laverone . | |
| 3,834,549 | 9/1974 | Burg et al. | 211/189 |
| 4,129,975 | 12/1978 | Gabriel . | |
| 4,869,380 | 9/1989 | Metcalfe et al. | 211/189 |
| 4,936,471 | 6/1990 | Walter | 211/189 |
| 5,531,464 | 7/1996 | Maurer et al. | 211/189 X |
| 5,580,181 | 12/1996 | Nomura | 403/217 X |
| 5,678,706 | 10/1997 | Husak et al. | 211/189 |
| 5,715,956 | 2/1998 | Yoshida | 211/182 |

*Primary Examiner*—Robert W. Gibson, Jr.
*Attorney, Agent, or Firm*—Angus C. Fox, III

[57] ABSTRACT

A new modular rack system is provided which can be ganged, expanded, contacted and modified in various ways, depending on the type of merchandise to be transported or stored. It can be readily moved by forklift and lifted by cables. Once the new modular rack system has fulfilled its transportation or storage function, it can be easily disassembled, transported, and stowed until needed for subsequent transportation and/or storage missions. In its most basic embodiment, the modular rack system generally comprises a plurality of beams, each beam consisting of an elongated member having first and second ends; and a plurality of coupler blocks, each block consisting of a three-dimensional polygonal body having a plurality of faces, each face having an aperture for receiving a single end of a beam, and each aperture including a retaining mechanism which releasably locks the received end within the aperture. For a preferred embodiment of the rack system, each coupler block has six cubically-arranged faces. Thus, by interconnecting multiple coupler blocks with multiple beams, cubic rack arrays of various shapes and sizes may be assembled. The length of the beams may be varied to accommodate various sizes and shapes of merchandise. The system further contemplates the incorporation of multiple shock absorbing feet, each of which is nestingly secured to a coupler block positioned at each lowermost corner of the rack array.

27 Claims, 11 Drawing Sheets

MODULAR RACK SYSTEM AND COMPONENTS THEREFOR

BACKGROUND OF THE INVENTION

1. Field of the Invention

The present invention relates to racks for shipping and storing industrial products. More particularly, the present invention relates to modular shipping and storage racks and components therefor.

2. Prior Art

As is well known to those working in the shipping and storage industries, there is a veritable plethora of rack systems used for the transport and/or storage of countless numbers of items ranging from fasteners, to automobiles, to heavy industrial equipment and so forth. Generally, such rack systems are designed for a particular purpose, such as the transport or storage of a particular type of item, be it tools, gears, bumpers, wheels, etc. As a rule, a rack system designed for a particular purpose is not readily adaptable for another purpose. For example, rack systems optimized for storage make poor shipping containers, as they are generally built to take primarily downward loads. In addition, such systems ordinarily provide little protection to the merchandise from the jolts and jarring that are inherent to stevedoring operations. On the other hand, rack systems optimized for shipment of merchandise generally make poor storage devices. To the applicant's knowledge, the design of rack systems which accommodate a wide range of products of varying size in both shipping and storage functions is still in its infancy.

What is needed is a modular rack system, the configuration of which can be readily modified to accept a variety of merchandise, and which can be ganged, expanded, contracted, or fitted with accessories, as needed. Additional desirable qualities would be that the modular rack system, when assembled and loaded, be easily moved by forklift and readily fitted with lift cables, and that when no longer needed for storage or transport purposes, it be easily disassemblable, stowable, and transportable.

SUMMARY OF THE INVENTION

As will subsequently be detailed hereinafter, the present invention provides a new modular rack system which can be ganged, expanded, contracted and modified in various ways, depending on the type of merchandise to be transported or stored. It can be readily moved by forklift and lifted by cables. Once the new modular rack system has fulfilled its transportation or storage function, it can be easily disassembled, transported, and stowed until needed for subsequent transportation and/or storage missions.

In accordance with the present invention, the modular rack system, in its most basic embodiment, generally comprises a plurality of elongated beams, each beam consisting of an elongated member having first and second ends; and a plurality of coupler blocks, each block consisting of a three-dimensional polygonal body having a plurality of faces, each face having an aperture for receiving a single end of a beam, and each aperture including a retaining mechanism which releasably locks the received end within the aperture. For a preferred embodiment of the rack system, each coupler block has six cubically-arranged faces. Thus, by interconnecting multiple coupler blocks with multiple beams, cubic rack arrays of various shapes and sizes may be assembled. The length of the beams may be varied to accommodate various sizes and shapes of merchandise. The system further contemplates the incorporation of multiple shock absorbing feet, each of which is nestingly secured to a coupler block positioned at each lowermost corner of the rack array.

For a preferred embodiment of the modular rack system, each beam, which is of generally chamferred square cross section, has a hollow core, and is equipped with a longitudinal slot on each of the four sides. Each slot extends the length of the side. Fasteners can be slidably inserted within the slots and used to removably mount flooring, shelves, protective covers, doors, hinges, and so forth. Once the flooring and shelves are installed, merchandise may be loaded on the rack system. The beams can optionally be fitted with forklift ears.

Also for a preferred embodiment of the modular rack system, each of the coupler blocks is provided with three bores which interconnect the apertures of opposing faces. Lift cables or the like may be strung may be strung through the bores and through the hollow core of any installed beams.

Because of the modular nature of the rack system, each of the components thereof may be conveniently packed in any suitable container or box for transport or storage. In addition, the new modular rack system is ideally suited to computer-controlled "pick and place" robotic assembly.

A variety of electronic equipment may be used in combination with the new modular rack system. In order to determine the shock loading to which the rack assembly has been subjected during transit, loading and unloading, an electronic shock recorder may be installed on the rack assembly in any suitable position. In addition, a rewritable electronic memory module may be installed for inventory manifest information storage, and such devices as radio-frequency identification tags having on-board memory may be attached thereto for both inventory for inventory-control, identification and shipment routing functions.

For a more detailed discussion of the present invention reference is made to the following detailed description and accompanying drawing figures. In the drawing figures, identical parts are numbered the same throughout the various views.

DETAILED DESCRIPTION OF THE INVENTION

Figure 1:
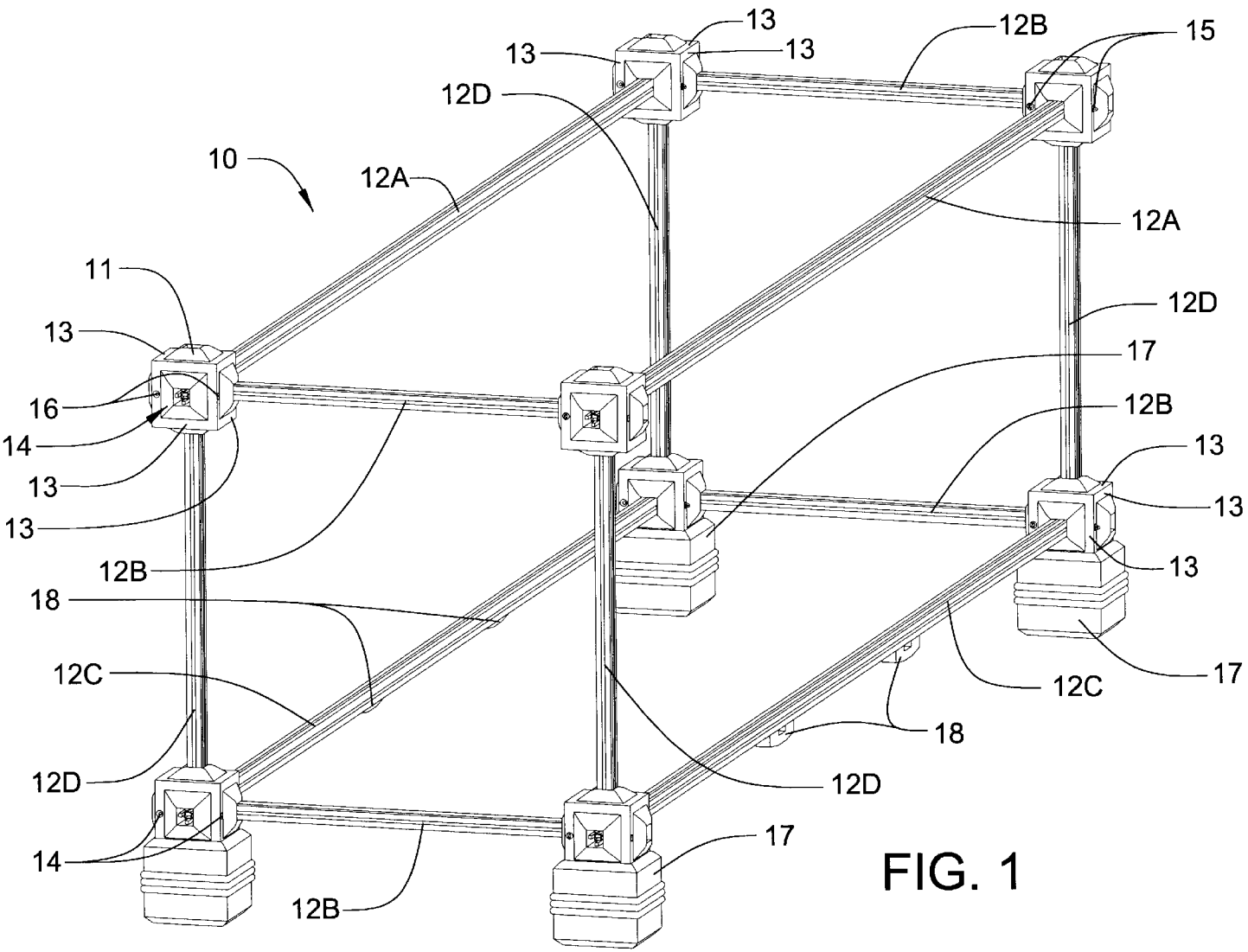
FIG. 1 is an isometric view of a modular rack system constructed from a plurality of coupler blocks, beams, and shock-absorbing feet, in accordance with the present invention.

At the outset, and as shown in the drawing and in particular FIG. 1, it is to be noted that the new modular rack system, as depicted in an exemplary rack array generally denoted 10, incorporates multiple units of two principal components: a coupler block 11, and a beam generally denoted 12. It will be noted that the beams are labeled 12A through 12D, as they are of different lengths or fitted with additional accessories. For example, although beams 12A and 12D are of identical length, beams 12D incorporate brackets which will be hereinafter described. Each coupler block 11 is designed such that it has six cubically-arranged faces; 3, each face being equipped with an appropriately-sized aperture 14 for slidably receiving one end of a beam 12. The received end of beam 12 may be locked within the aperture by means of a retaining pin 15, which is inserted within a pin insertion hole 16 in the coupler block, thereby also passing through a locking hole (not shown in this Figure) in the end of the received beam. Each of the six apertures 14 has associated therewith a pin insertion hole 16 in the coupler block for receiving a retaining pin 15. The modular rack system also incorporates multiple shock absorbing feet 17, each of which is nestingly secured to a coupler block 11 positioned at each lowermost corner of the rack array 10. It will be noted that each of beams 12D incorporate a pair of forklift stirrups 18, which provide not only correct positioning of lifting forks, but also prevent the array 10 from tipping during lifting. Such forklift stirrups 18 may be mounted with fasteners, slidably mounted within the T-shaped longitudinal grooves of the beam 12 (see the detailed description of FIG. 6), or may be welded to the beams 12.

Figure 2:
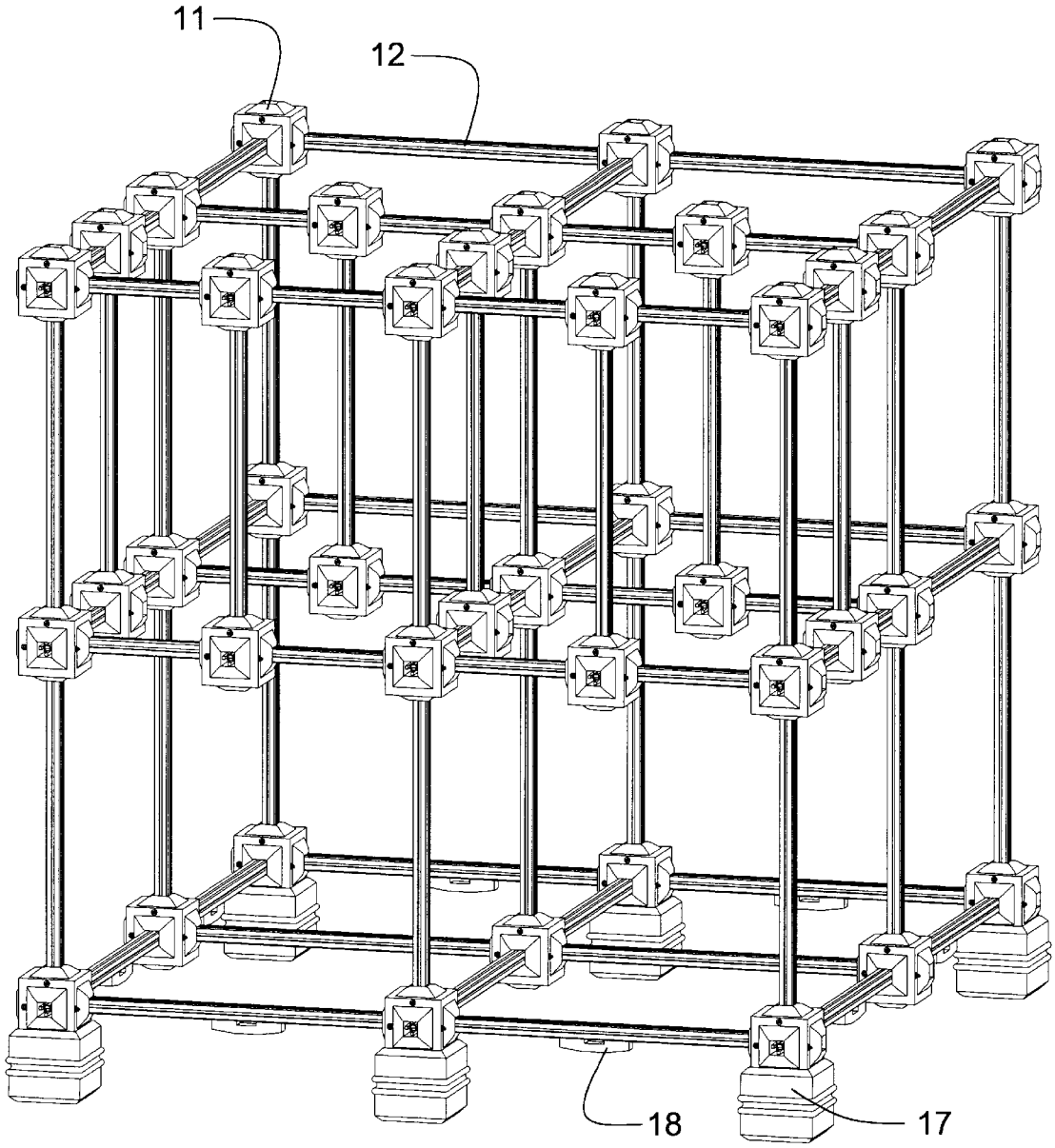
FIG. 2 is an isometric view of a complex modular rack array constructed from multiples of the basic components depicted in FIG. 1.

It should be evident that a variety of rack array configurations may be formed by combining coupler blocks 11 and beams of various lengths 12 in a virtually limitless number of ways. FIG. 2, which depicts one such combination, includes forty-one coupler blocks 11, seventy-five beams 12, and six shock-absorbing feet 17. Although the rack array of FIG. 2 is only one possible combination of coupler blocks 11 and beams 12, it demonstrates the versatility of the new modular rack system.

Figure 3:
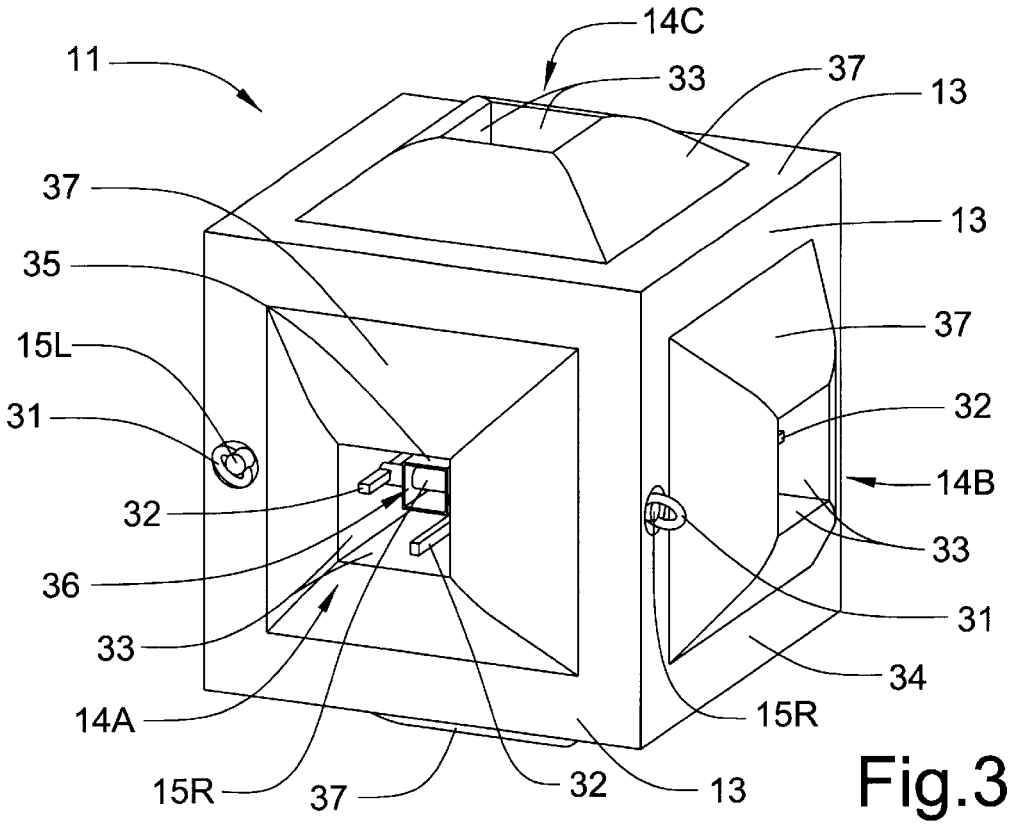
FIG. 3 is an isometric view of a coupler block, a plurality of which are used to construct the modular rack system.

Referring now to FIG. 3, certain features of the coupler block 11 that were described while referring to FIG. 1 are now more clearly visible. For example, three apertures 14A, 14B, and 14C of the six apertures (generally denoted 14) in coupler block 11 are visible, as are a pair of retaining pins 15A and 15B, which are shown inserted in their respective pin insertion holes 16 in the coupler block 11. The right-most pin 15B is also visible within aperture 14A. It will be noted that each retaining pin (generally denoted 15) has a pull ring 31 attached thereto. The interior of each aperture 14 incorporates four alignment guide rails 32 (one on each aperture wall 33), two of which are visible in aperture 14A, and one of which is visible in aperture 14C. The coupler blocks 11 may be cast as a single unit from a lightweight structural metal such as aluminum or magnesium, or it may be formed as a composite item, having a central connector assembly (not shown in its entirety in this Figure) formed, ideally, from a high-strength wear-resistant metal, that is insert molded within a durable body 34 which incorporates the apertures 14 and guide rails 32 and gives the coupler block 11 its general exterior shape. The central connector assembly, which may be fabricated as a welded-up unit from a metal such as steel or titanium extends into each of the six apertures of the coupler block 11. If a coupler block is fabricated in such a manner, the square tube 35 visible in aperture 14A is such an extension. If a coupler block 11 is cast or machined as a single unit, then the body 34 and the entire central connector assembly, which includes square tube 35, are simply part of a single casting. In any case, each square tube extension 35 has a anchoring hole 36 therethrough for receiving a retaining pin 15. This anchoring hole 36 is aligned with the pin insertion hole 16 through the coupler block body 34. The beams 12 of a rack system array are tied to this central connector assembly. If the coupler block 11 is formed as a composite item, the coupler block body 34 may be formed from any suitable, durable material, such as a plastic, a lightweight metal such as aluminum or magnesium or alloys thereof, or the like. Useful plastic materials include ABS resins, epoxy resins, high-density polyethylene, polyalkylenes, polycarbonates, and polyurethanes used either alone or in combination with reinforcing high-tensile-strength fibers, such glass or graphite. When made of a moldable material, the coupler block body 34 is formed by any suitable molding process known to the skilled artisan. It is to be understood that it is not the particular material or the method by which it is molded that is a critical factor, but rather that the body be formed from a suitable durable material. Although the coupler block body 34 may theoretically have any desired three-dimensional polygonal configuration (e.g., pyramidal, pentahedral, cubic, octahedral or decahedral), a cubic configuration is preferred, as it permits rectangular rack arrays. As will be noted each of the six faces 13 of the coupler block body 34 has a boss 37 which surrounds the aperture 14. The boss 37 imparts additional strength to the coupler block body 34 without a corresponding increase in total weight.

Figure 4:
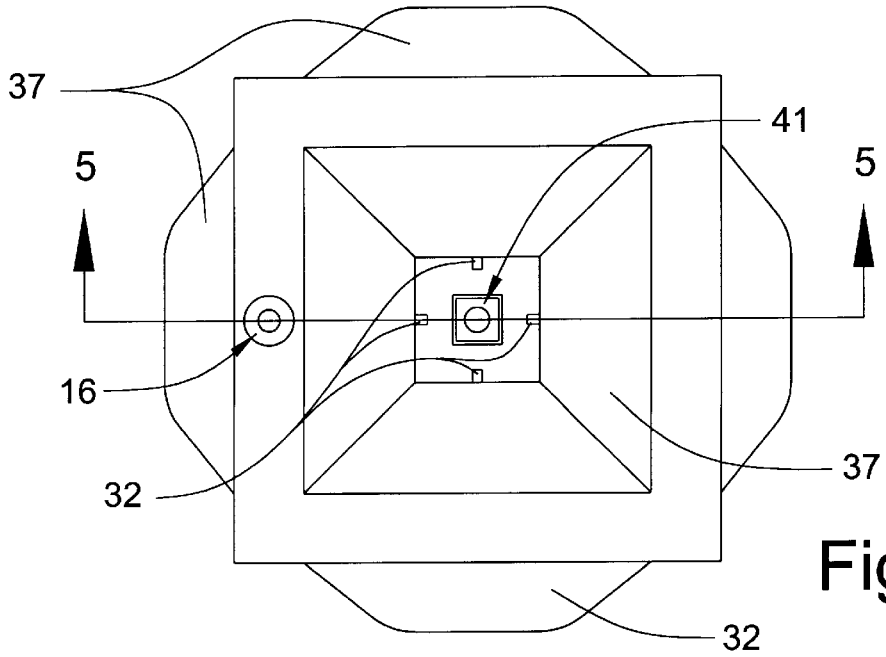
FIG. 4 is a top plan view of a coupler block.

Referring now to FIG. 4, certain features of the coupler block are more clearly defined. For example, in this view, all four guide rails 32 within an aperture 14 are seen, as is a retaining pin insertion hole 16 (the longitudinal axis of which is perpendicular to the page), boss 37, and the square-cross-section tube 35. Also visible is a central threaded hole 41. The aperture 14 of each face has a threaded hole 41.

Figure 5:
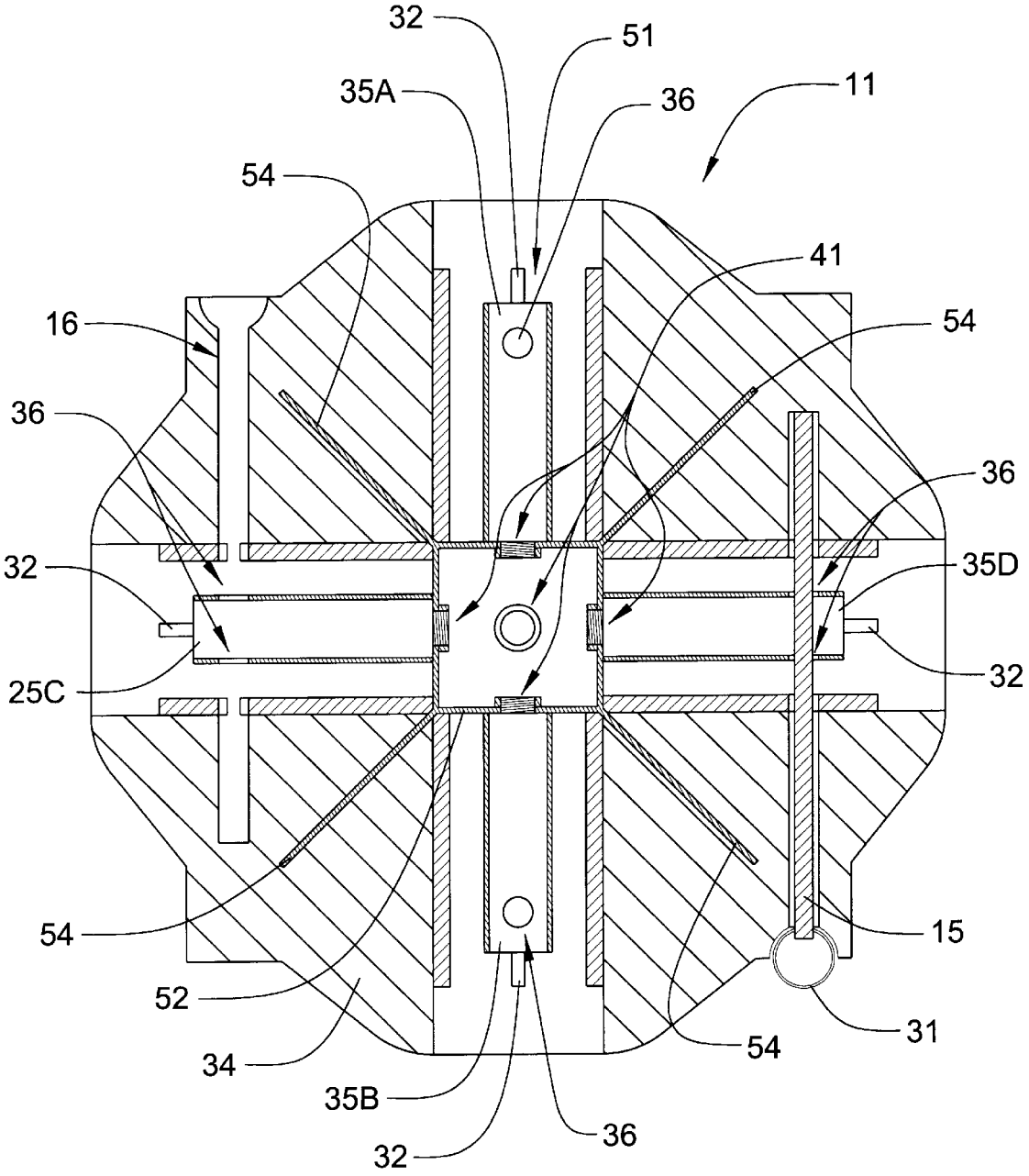
FIG. 5 is a cross-sectional view of a coupler block taken along line 5—5 of FIG. 4.

Referring now to FIG. 5, this cross-sectional view is shown mainly to expose the central connector assembly 51 of a composite coupler block 11. This central connector assembly may be formed as a single piece of metal by casting or machining, or it may be welded-up from various components. Visible in this view are four square tube extensions 35A, 35B, 35C and 35D, which are associated with four of the six faces of the coupler block. In this view, tube extensions 35A, 35B, 35C and 35D have been sliced open. One of each pair of anchoring holes 36 in tube extensions 35A and 35B is visible in one wall of square tube extensions 35A and 35B, where as half of each anchoring hole 36 in the opposing walls of square tube extensions 35C and 35D are visible. It should be emphasized that the interior structure visible in a cross-section through any of the six faces will be essentially the same. The welded-up central connector assembly 51 is formed from hollow interior cube 52. One square tube extension 35 is welded to each of the six faces of this interior cube 52. In the center of each region of a face of the interior cube 52 is a threaded hole 41. The threaded holes 41 in opposing sides not only permit passage of a supporting cable through the center of the coupler block 11, but also provide a threaded anchor for a bolt which may be used to attach a shock-absorbing foot 18 to any of the six faces 13 of the coupler block 11. Each edge of the interior cube 52 has a fin 54 welded thereto. The eight fins 54 (one for each edge of the cube) are imbedded within the material from which the coupler block body 34 is cast, and assist in maintaining the welded-up central connector assembly 51 firmly anchored within the coupler block body 34.

Figure 6:
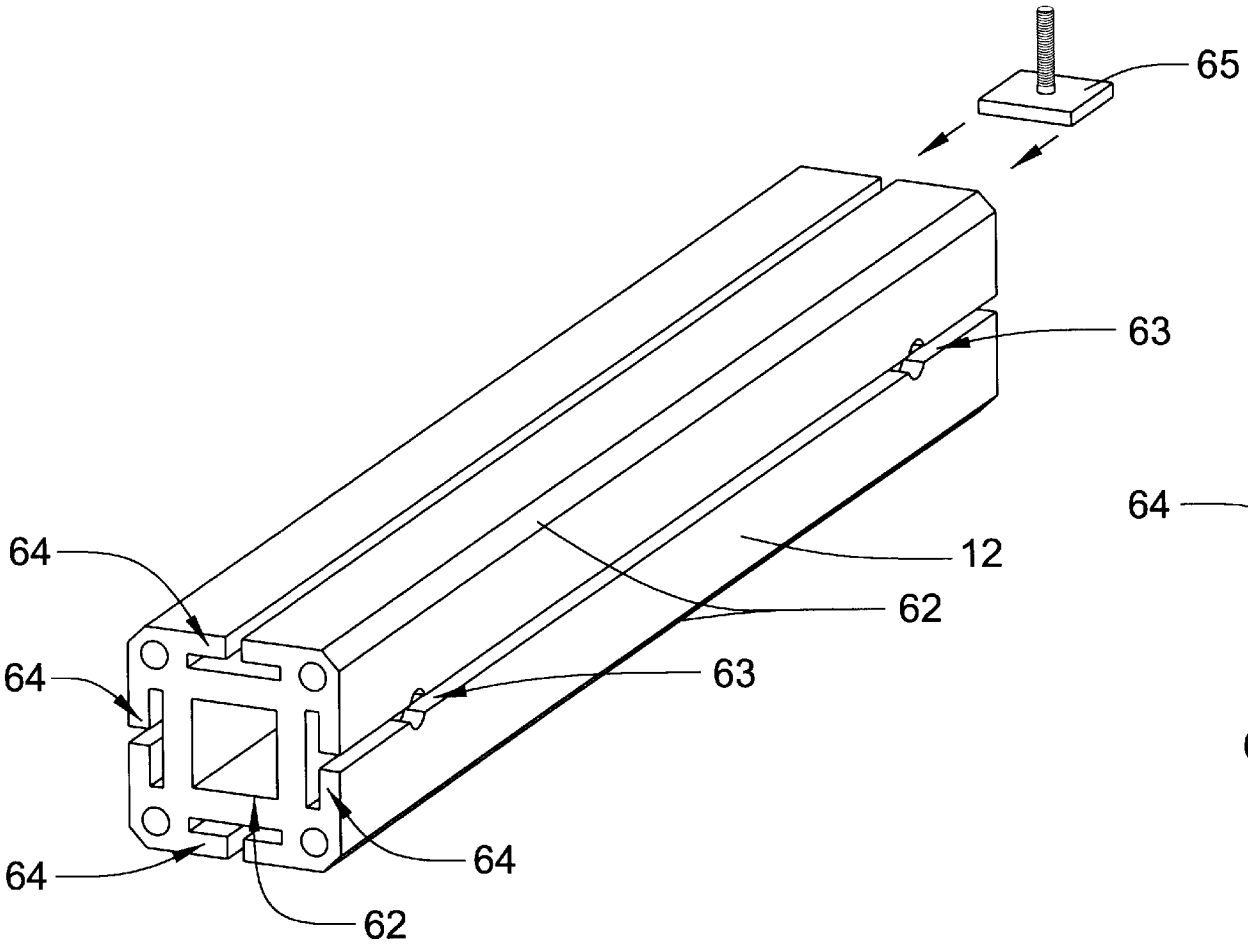
FIG. 6 is an isometric view of a beam.
Figure 10:
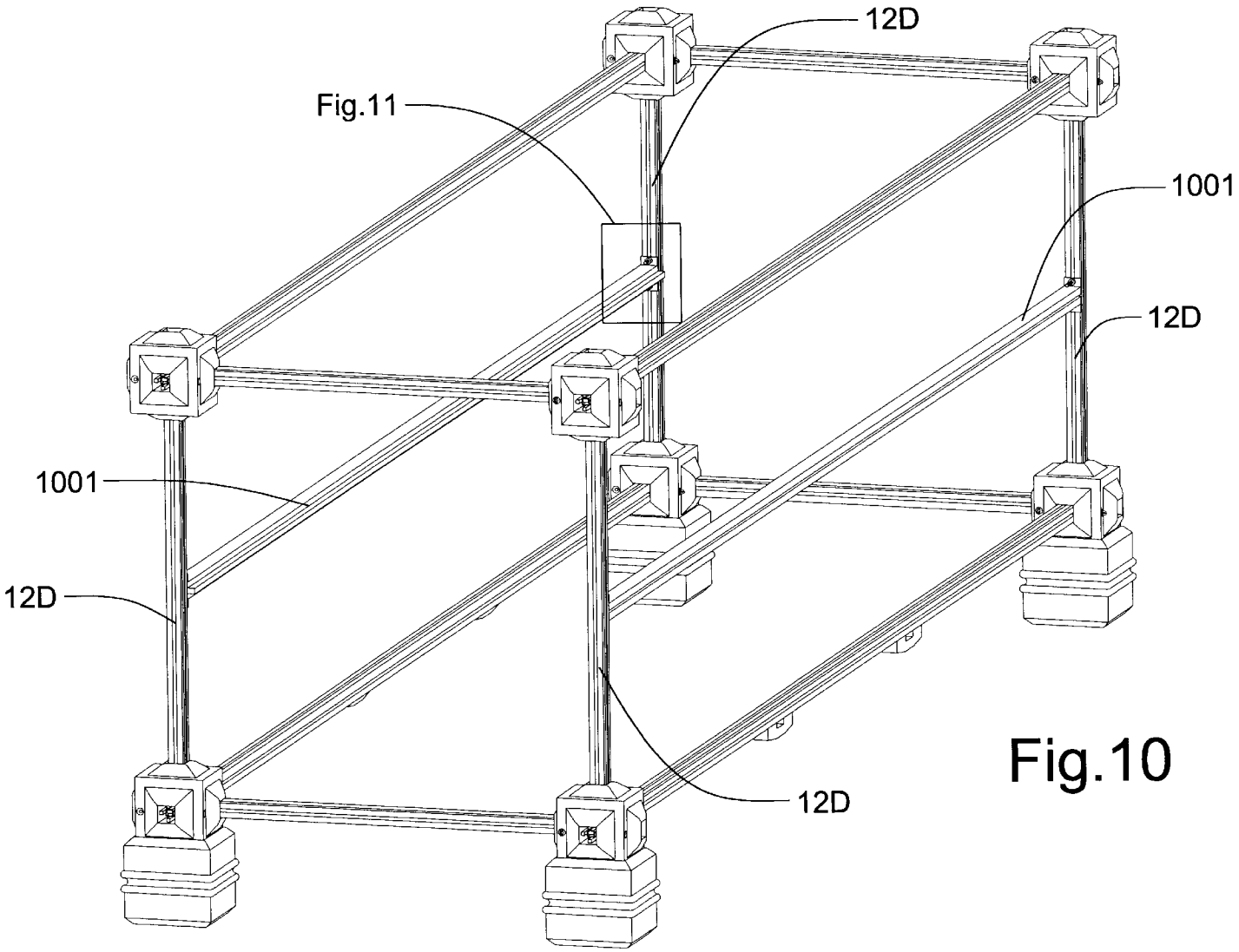
FIG. 10 is an isometric view of drawer guides which can be mounted within the modular rack system.
Figure 11:
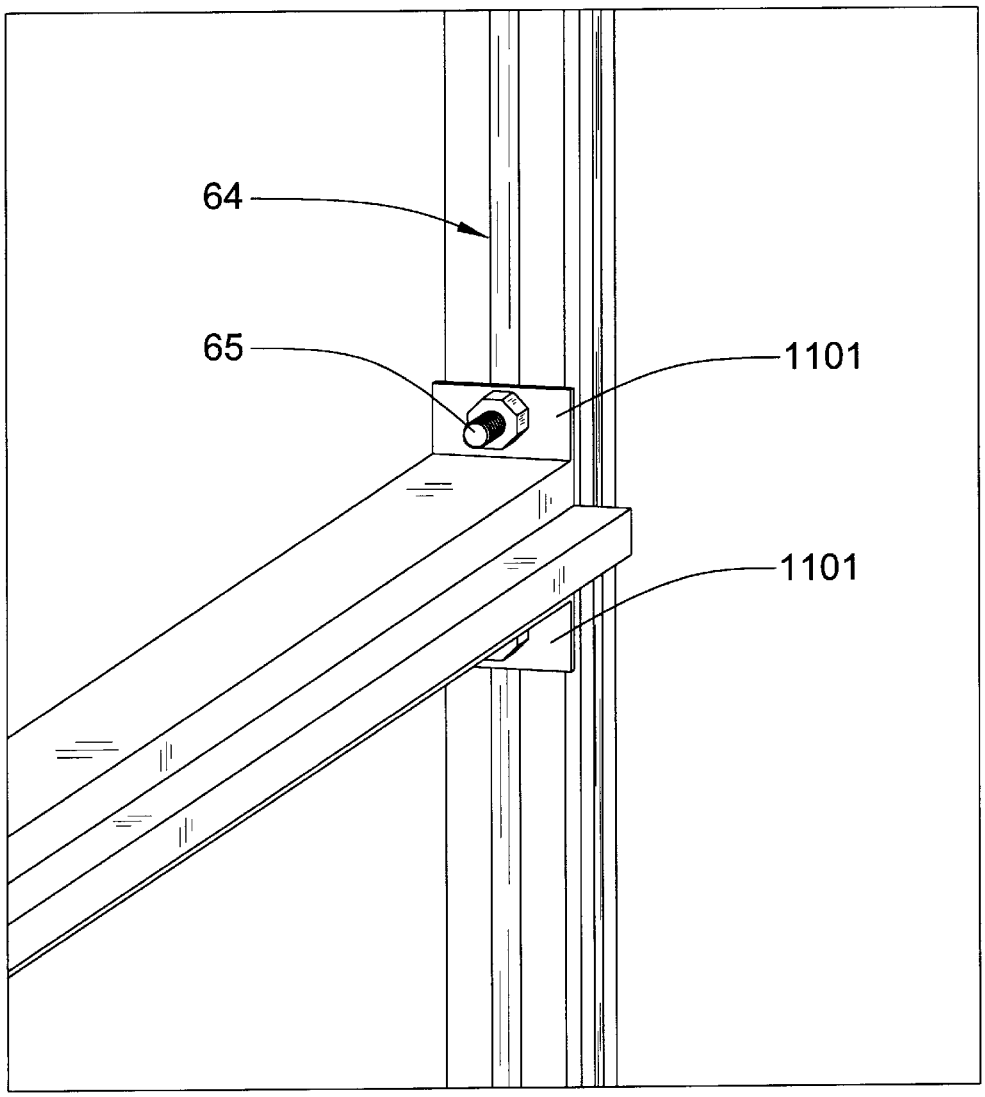
FIG. 11 is a close-up view of the guide-to-rack attachment area identified in FIG. 10.

Referring now to FIG. 6, certain features of the beam 12 which were previously alluded to are now clearly visible. For a preferred embodiment of the invention, each beam 12 is extruded from a light, high-strength metal such as aluminum, magnesium or an alloy thereof. Each beam 12 is of more or less square cross-section, having chamferred edges 61 and a hollow core 62 which extends the entire length of the beam. As heretofore stated, each end of the beam 12 incorporates a locking hole 63, both of which are now visible in this view. Each of the four sides of the beam incorporates a T-shaped longitudinal groove 64, which, like the hollow core 62, extends the entire length of the beam. Threaded fasteners 65, which are essentially bolts having a square or rectangular head sized to fit the groove 64, may be inserted within the groove and employed to removably mount protective covers, flooring, shelves, doors, hinges, and so forth on the beams 12. With the flooring and shelving so installed, merchandise may then be loaded on the modular rack array 10. Furthermore, by the disposition of suitable auxiliary components, it is possible to install drawers within a rack array. Such an installation is shown in FIGS. 10 and 11.

Figure 7:
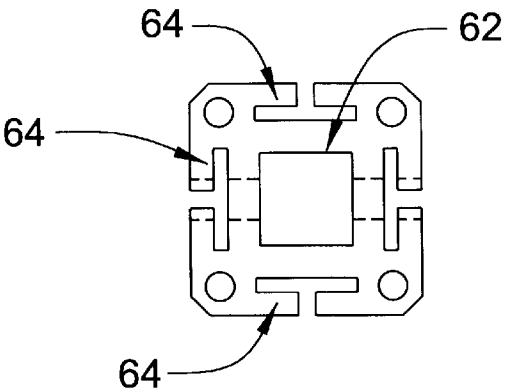
FIG. 7 is an end view of a beam perpendicular to its longitudinal axis.

Referring now to FIG. 7, the substantially square cross section of a beam 12 is clearly evident. Each of the four T-shaped grooves 64 is clearly visible, as is the hollow central core 62.

Figure 8:
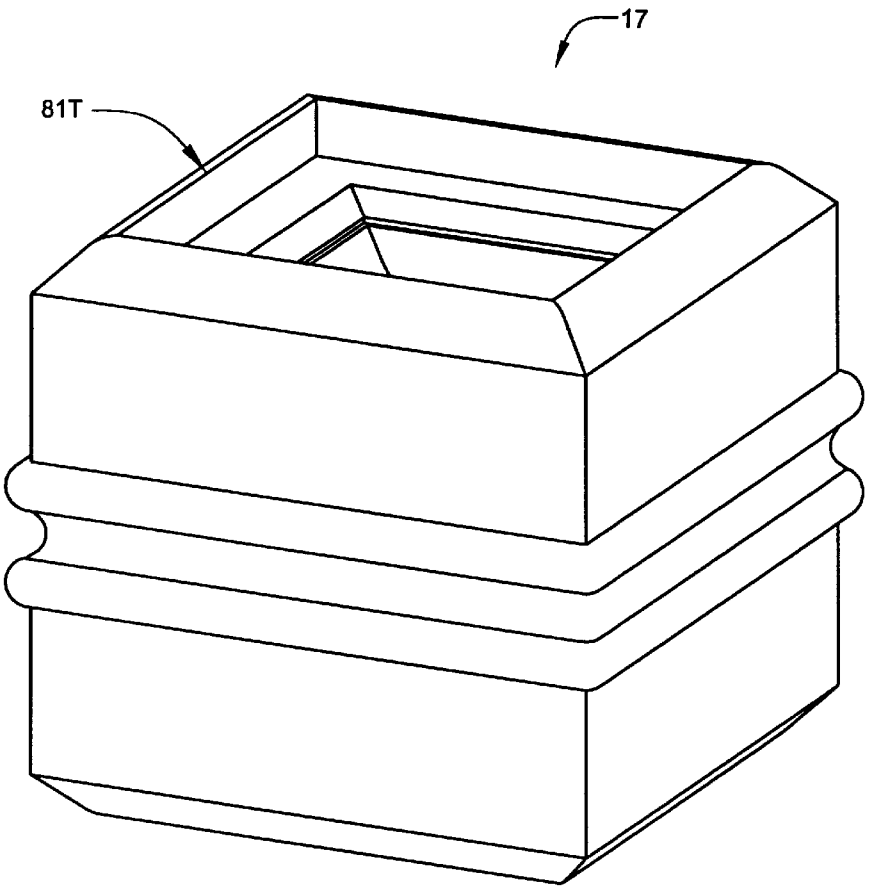
FIG. 8 is an isometric view of a shock-absorbing foot.

Referring now to FIGS. 8, a shock-absorbing foot 18, which is generally of cubical shape, also has a recess 81T on the top thereof which nestingly receives the face and boss of a coupler block.

Figure 9:
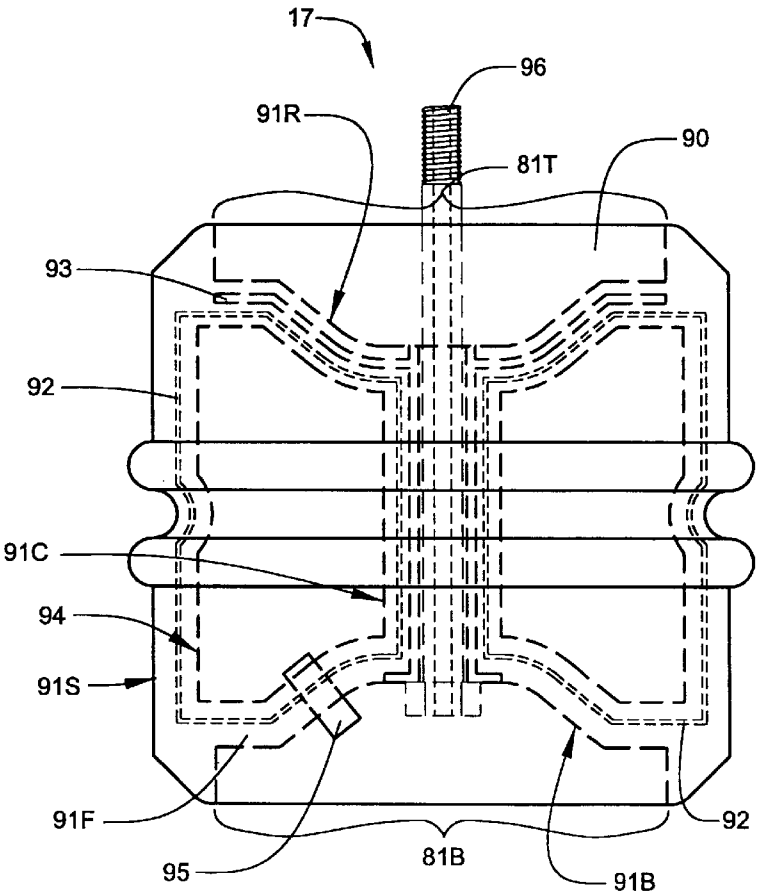
FIG. 9 is a side elevational phantom view of a shock-absorbing foot.

Referring now to FIG. 9, a preferred embodiment of the shock-absorbing foot 18 is formed from a body 90 formed from flexible polymeric material, such as butyl or natural rubber (or a combination of the two) that is reinforced in the sidewalls 91S and in the floor portion 91F, much like a vehicle tire, with high-tensile cord 92, such as nylon, kevlar, polyester, rayon, etc. The top recess 81T and a bottom recess 81B are formed in the body. Each recess 81T or 81B is sized to nestingly receive the face 13 and boss 37 of a coupler block 11. A generally inflexible insert 93 is embedded within the flexible polymeric material of a roof portion 91R, central core portion 91C, and the bottom portion 91B of the foot 18. A compressible internal chamber 94 is formed by the sidewalls 91S, the roof portion 91R, and the floor portions 91F of the foot 18. A valve 95 may be incorporated in the foot 18, which allows the chamber 94 to be pressurized with air or some other appropriate gas to accommodate loads of varying weights. A hollow-core mounting bolt 96 is used to secure the foot 18 to a coupler block 11. The internal chamber 94, particularly when inflated, defines a compressible shock absorber or bumper which not only protects an attached coupler block 11, but also protects the entire rack array 10 and the merchandise stored therein from excessive jarring and shock. In order to determine the shock loading to which the rack array 10 has been subjected during transit, loading and unloading, an electronic shock recorder may be installed on the rack assembly in any suitable position. It is to be appreciated that in assembling a rack, such as that disclosed in FIG. 1, that further stacking can be achieved and that a foot 18 can be disposed between adjacent vertical or horizontal associated coupler blocks 11 for heavier loads and for lateral impact. Also, a plurality of lugs can be nested together at any desired intersection. Otherwise, interconnecting struts and lugs can be used.

Referring now to both FIGS. 4, 6 and 9, as there is no blockage between threaded holes 41 of opposed faces, a cable may be threaded through a coupler block 11 via any opposed pair of threaded holes 41. As has been seen, each beam 12 has a hollow center, which permits a cable or lifting rod to be strung up through the hollowcore mounting bolt inserted within a shock-absorbing foot 18, through a coupler block 11, through the core of a beam 12, then through another coupler block, and so forth, until reaching the top of the rack array, where it may be utilized, in combination with other cables so positioned, to lift the rack array. A swedged-on cable end may be used to anchor the cable and also hold the foot 18 on the rack array.

It is to be appreciated that electronic tagging devices may be associated with the present modular rack system for identification, inventory control and shipment routing. For example, one or more electronic modules may be attached to the rack system. A radio-frequency identification tag having rewritable on-board memory may be used for shipment identification, inventory control and shipment routing functions. A simpler electronic module might only provide a rewritable memory for storing an electronic inventory list and shipping manifest.

Figure 12:
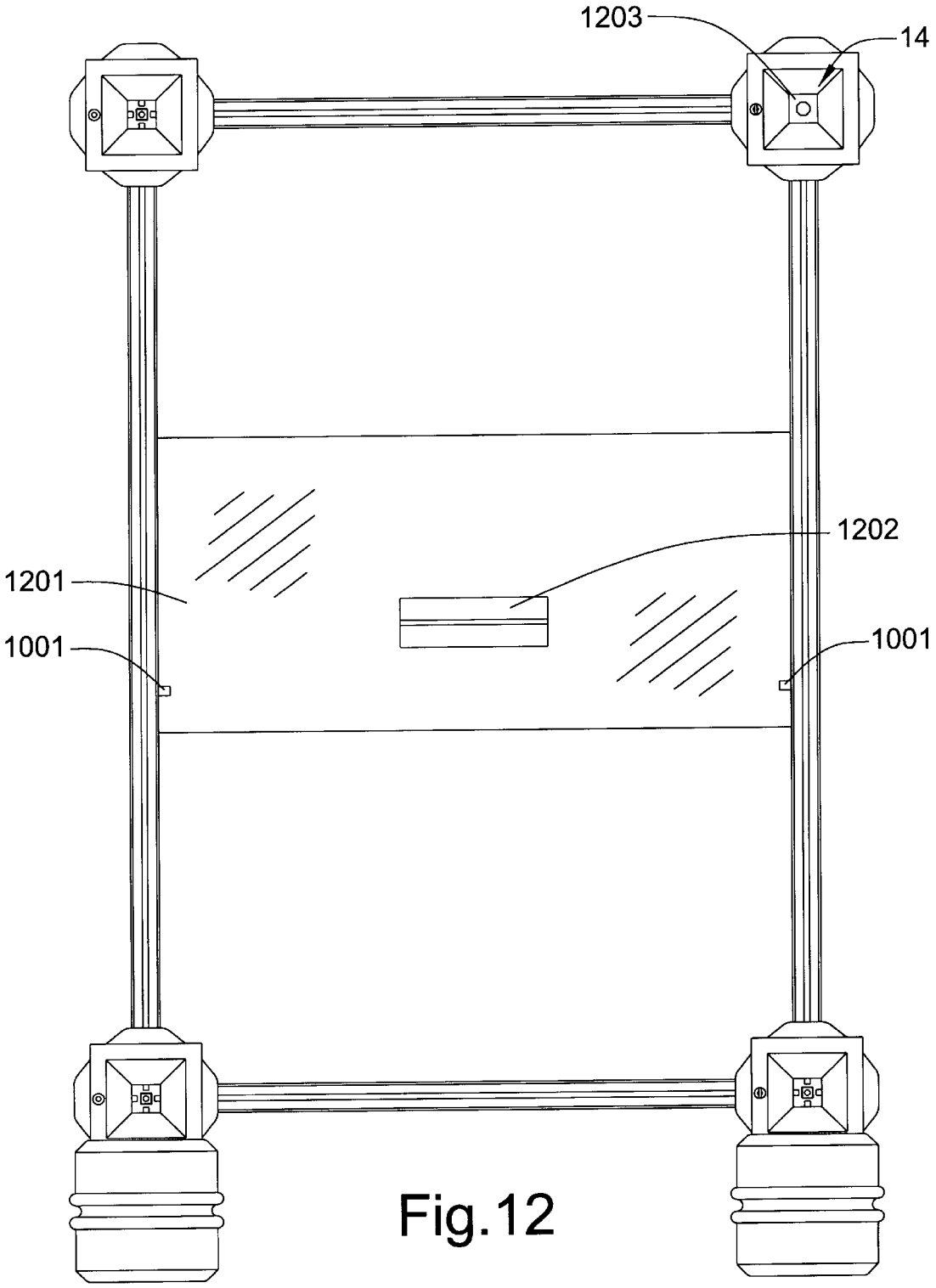
FIG. 12 is a side elevational view of a modular rack system following the installation of drawer guides and a drawer.

Referring now to FIG. 10, the modular rack array of FIG. 1 is shown with a pair of drawer guides 1001 installed between vertically-oriented beams 12D. As is seen in the close-up view of FIG. 11, the end of each drawer guide has a pair of tabs 1101, each tab having a bolt hole by means of which the tab may be secured to a threaded fastener 65 inserted within the T-shaped groove 64 of the beams 12D. In the front elevational view of FIG. 12, a drawer 1201 having a handle 1202 is shown mounted on the drawer guides 1001. An electronic module 1203, which may provide at least some of the features described in the foregoing paragraph, is shown secured within an unused aperture 14 of a coupler block 11.

Figure 13:
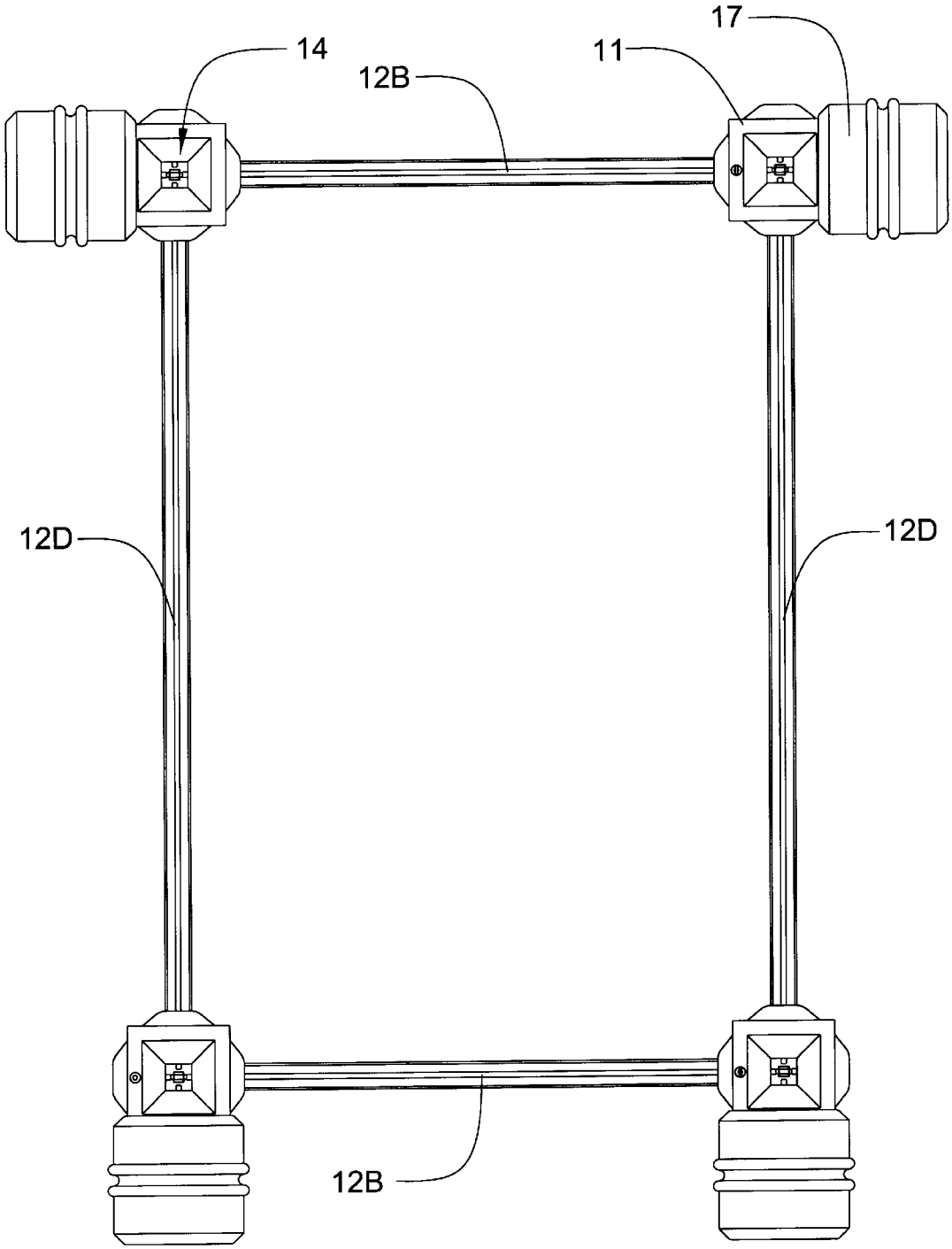
FIG. 13 is a side elevational view of a modular rack system having laterally-mounted shock-absorbing feet.

Referring now to FIG. 13, a pair of shock-absorbing feet 17 are laterally mounted on the upper-most coupler blocks 11. The use of the shock-absorbing feet 17 in this manner protects the rack array and any merchandise stored therein from lateral shocks.

Figure 14:
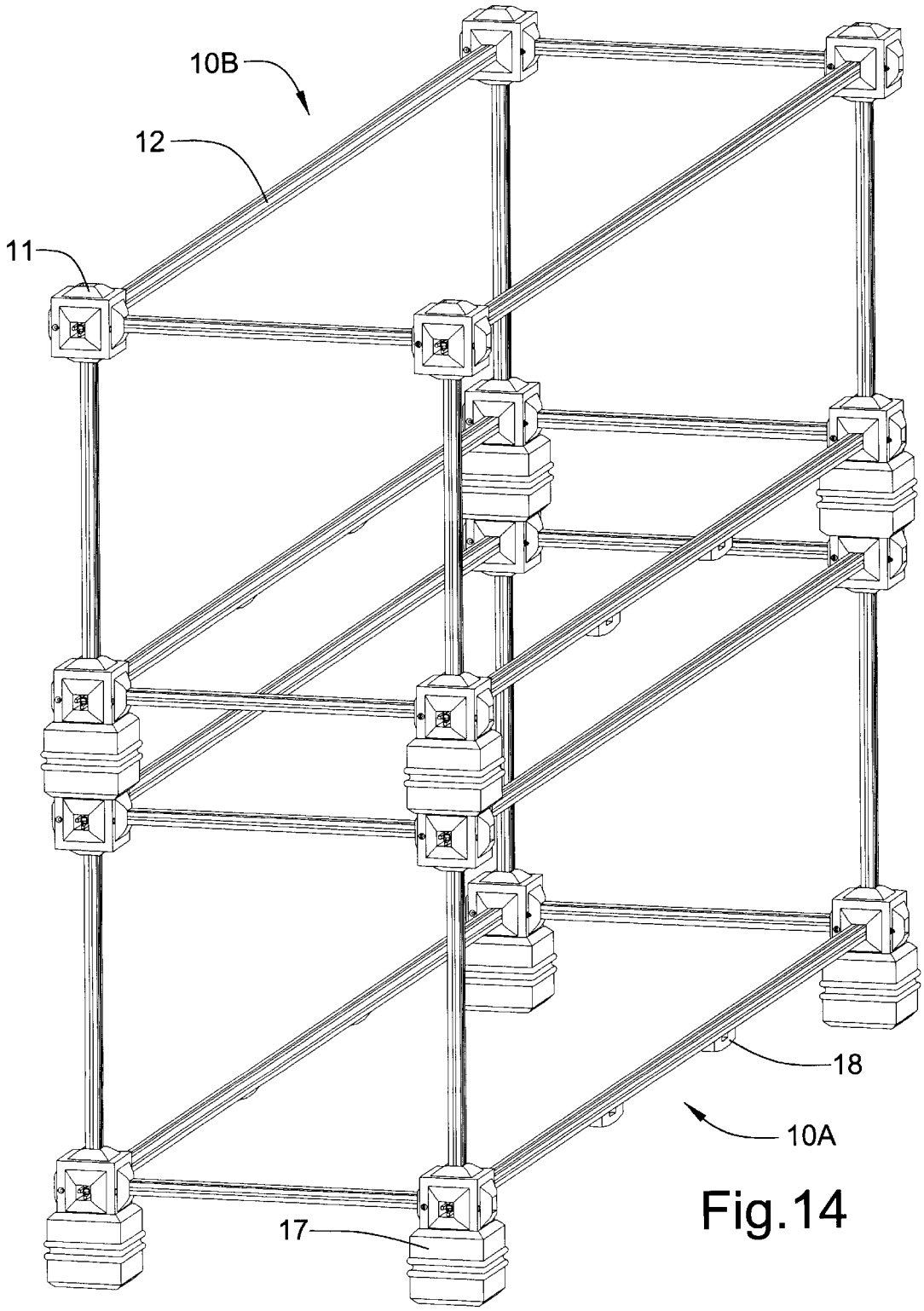
FIG. 14 is an isometric view of two modular rack systems, one of which has been stacked on top of the other.

Referring now to FIG. 14, two rack arrays 10A and 10B are shown with rack array 10B being stacked on top of rack array 10A. In this case, the upper-most coupler blocks of the lower rack array 10A are nested in the shock-absorbing feet mounted on the lower-most coupler blocks of the upper rack array 10B. The nesting feature maintains stacking alignment during transport of the rack arrays, even in the face of normal vertical and lateral forces that occur during shipment.

It should now be fully appreciated that the design of the coupler block 11 and longitudinal beams 12 enables the erection of a virtually limitless variety of rack arrays using multiple coupler blocks 11 and a plurality of beams 12 of desired lengths. In addition, the new modular rack system is ideally suited to computer-controlled "pick and place" robotic assembly. The modular rack system herein described also accommodates electronic monitoring of shock forces to which the system is subjected.

Although certain specific embodiments of the coupler block and beam have been defined herein, it is to be appreciated that modularity is the single most important feature of the new modular rack system. Changes and modifications to the system may be made without departing from the scope and spirit of the invention as hereinafter claimed. For example, other means for securing the beams to the coupler blocks may be employed. Similarly, other types of coupler blocks and beams which similarly cooperate may also be used.

What is claimed is:

1. A modular rack array, comprising:

a plurality of elongated beams, each beam having a pair of opposed ends, each end having a locking hole;

a plurality of coupler blocks, each of which has a plurality of external faces, each face having an aperture for receiving an end of a beam, and each aperture having associated therewith a pin retaining hole and a locking mechanism associated with each aperture for releaseably locking the received end of a beam therein, said locking mechanism comprising a retaining pin which is removably insertable within said pin retaining hole, said retaining pin passing through the locking hole of the received end.

2. The modular rack array of claim 1, which further comprises a plurality of shock-absorbing feet, each foot nestingly mated to a face of a single coupler block.

3. The modular rack array of claim 1, wherein each of said coupler blocks has a cubic configuration having six faces, each face being perpendicular to four adjacent faces.

4. The modular rack array of claim 3, wherein each face includes a pin retaining hole for the aperture of an adjacent face.

5. The modular rack array of claim 1, wherein each coupler block is formed from a single metal casting.

6. The modular rack array of claim 5, wherein said metal is selected from the group of metals consisting of aluminum, magnesium and alloys of aluminum and magnesium.

7. The modular rack array of claim 1, wherein each beam is of substantially rectangular cross section and has a groove on each of its four major faces, each of said grooves providing an anchor for threaded fasteners.

8. The modular rack array of claim 7, wherein shelves and protective siding are attached to the beams via the threaded fasteners.

9. The modular rack array of claim 1, wherein each elongated beam has a hollow core which extends the length of the beam, and each beam has a locking hole at each end thereof.

10. The modular rack array of claim 7, wherein each coupler block is fabricated as a composite structure, said structure comprising:

a central connector assembly having a hollow cubic structure with six sides, each side being associated with a single face of the coupler block;

a tube centrally and perpendicularly affixed to a side of said cubic structure, each tube sized for slidably mating within the hollow core at the end of an elongated beam, each tube having an anchoring hole aligned to the locking hole of a mated beam.

11. The modular rack array of claim 10, wherein each side of the hollow cubic structure has a central threaded hole that is coaxial with the attached tube, said threaded hole sized to receive a threaded member providing an anchor point for an attached shock-absorbing foot.

12. The modular rack array of claim 2 wherein each shock-absorbing foot comprises a body having an outer shell, a central core, and a hollow pressurizable interior chamber surrounding said central core, said outer shell being formed with an upper recess for nestingly receiving one face of a coupler block, said core having an axial bore for receiving a threaded member with which said foot may be secured to a nested face.

13. The modular rack array of claim 1, which further comprises at least one electronic tagging device mounted thereon, said tagging device being selected from the group consisting of shipment identification devices, inventory control devices and shipment routing devices.

14. A modular rack array comprising:

a plurality of elongated beams, each beam having a pair of opposed ends, each end having a locking hole therein;

two retaining pins for each beam; and a plurality of coupler blocks, each of which has six cubically-arranged external faces, each face having an aperture for receiving an end of a beam, each aperture having associated therewith a pin insertion hole for receiving a retaining pin, said retaining pin passing through the locking hole in the end of a beam when a beam is inserted within the aperture, thereby releasably locking the beam end within the aperture.

15. The modular rack array of claim 14, wherein each end of each beam is locked into one aperture of one of said plurality of coupler blocks.

16. The modular rack array of claim 14, which further comprises a plurality of shock-absorbing feet, each foot nestingly mated to a face of a single coupler block.

17. The modular rack array of claim 14, wherein each beam is of substantially rectangular cross section and has a groove on each of its four major faces, each of said grooves providing an anchor for threaded fasteners.

18. The modular rack array of claim 17, wherein shelves and protective siding are attached to the beams via the threaded fasteners.

19. The modular rack array of claim 14, wherein each elongated beam has a hollow core which extends the length of the beam.

20. The modular rack array of claim 14, wherein each coupler block is formed from a single metal casting.

21. The modular rack array of claim 20, wherein said metal is selected from the group of metals consisting of aluminum, magnesium and alloys of aluminum and magnesium.

22. The modular rack array of claim 20, wherein each coupler block is fabricated as a composite structure, said structure comprising:

a central connector assembly having a hollow cubic structure with six sides, each side being associated with a single face of the coupler block;

a tube centrally and perpendicularly affixed to a side of said cubic structure, each tube sized for slidably mating within the hollow core at the end of an elongated beam, each tube having an anchoring hole aligned to the locking hole of a mated beam.

23. The modular rack array of claim 22, wherein each side of the hollow cubic structure has a central threaded hole that is coaxial with the attached tube, said threaded hole sized to receive a threaded member providing an anchor point for an attached shock-absorbing foot.

24. The modular rack array of claim 16 wherein each shock-absorbing foot comprises a body having an outer shell, a central core, and a hollow pressurizable interior chamber surrounding said central core, said outer shell being formed with an upper recess for nestingly receiving one face of a coupler block, said core having an axial bore for receiving a threaded member with which said foot may be secured to a nested face.

25. A modular rack array of claim 14, which further comprises at least one electronic tagging device mounted thereon, said tagging device being selected from the group consisting of shipment identification devices, inventory control devices and shipment routing devices.

26. The modular rack array of claim 14, wherein each shock-absorbing foot has a lower recess which permits the rack array to be stacked on top of a similarly sized lower rack array with each lower recess nesting with a coupler block of the lower rack array.

27. The modular rack array of claim 14, which further comprises at least one electronic tagging devices mounted thereon, said tagging device being selected from the functionality group consisting of shipment identification, inventory control and shipment routing.

* * * * *